United States Patent [19]

Strock

[11] Patent Number: 4,763,805

[45] Date of Patent: Aug. 16, 1988

[54] UNDERGROUND TANK ASSEMBLY WITH INTERNAL BLADDER

[75] Inventor: Dennis J. Strock, Woodridge, Ill.

[73] Assignee: Amoco Corporation, Chicago, Ill.

[21] Appl. No.: 3,718

[22] Filed: Jan. 16, 1987

Related U.S. Application Data

[62] Division of Ser. No. 673,420, Nov. 20, 1984, Pat. No. 4,648,523.

[51] Int. Cl.[4] ..... B65D 25/18

[52] U.S. Cl. ..... 220/85 A; 220/85 B; 220/85 F; 220/85 V

[58] Field of Search ..... 220/85 A, 85 B, 85 F, 220/86 R, 85 VR, 85 VS, 22, 216, 225

[56] References Cited

U.S. PATENT DOCUMENTS

| | | | |
|---|---|---|---|
| 2,289,139 | 7/1942 | Marner | 220/85 B |
| 3,658,080 | 4/1972 | Mitchell | 220/85 B |
| 3,747,800 | 7/1973 | Viland | 220/85 B |
| 3,906,880 | 9/1975 | Hebert | 220/85 B |
| 4,085,865 | 4/1978 | Thompson et al. | 220/85 B |
| 4,254,887 | 3/1981 | Bold | 220/85 B |
| 4,256,150 | 3/1981 | Mockesch | 220/85 B |
| 4,408,628 | 10/1983 | Monk | 220/85 B |

*Primary Examiner*—Joseph Man-Fu Moy

*Attorney, Agent, or Firm*—Thomas W. Tolpin; William H. Magidson; Ralph C. Medhurst

[57] ABSTRACT

An improved underground tank assembly is provided for storing motor fuels, such as gasoline or diesel fuel. The underground tank assembly has an expandable bladder-like primary tank positioned within the interior of a rigid secondary tank. Advantageously, the secondary tank meets most safety regulations and secondary containment laws by dependably providing for secondary containment of any leakage of motor fuel from the primary tank. The underground tank assembly has numerous alternative conduit arrangements for ease and flexibility of assembly, installation, and manufacture. The underground tank assembly also desirably has a protective barrier wall for protecting and isolating the conduits from the expanded primary tank. Other safety equipment and controls, such as leakage detectors, are provided.

13 Claims, 6 Drawing Sheets

UNDERGROUND TANK ASSEMBLY WITH INTERNAL BLADDER

This application is a division of application Ser. No. 673,420 filed Nov. 20, 1984 of Dennis J. Strock for An Underground Tank Assembly with Internal Bladder now U.S. Pat. No. 4,648,523.

BACKGROUND OF THE INVENTION

This invention relates to storage tanks, and more particularly to underground tanks for storing motor fuel, such as gasoline or diesel fuel.

Underground tanks and aboveground tanks used for storing petroleum and petrochemicals are normally designed to be leakage resistant to minimize loss of their contents in or onto the ground, which in excess amounts might contaminate the soil and pollute surrounding areas.

Over the years, a number of underground, aboveground, and transportation tanks have been developed for storing petroleum, petrochemicals, and other materials. Typifying these prior art storage tanks are those found in U.S. Pat. Nos. 2,758,747; 3,747,800; 4,230,061; 4,374,478; and 4,408,628. These prior art tanks have met with varying degrees of success.

In recent years, many states, such as New York, Florida, and California, have enacted secondary containment laws or regulations to further protect the environmental quality of the land and surrounding area on which the tanks are located. Secondary containment laws and regulations generally require operators or owners of tanks storing petroleum, chemicals, or hazardous material, to provide a secondary containment vessel, such as an exterior shell or a leak-proof housing, which would surround the tank and serve as a backup safety vessel to contain any materials which might leak out of the primary tank.

In an effort to comply with these secondary containment laws and regulations, some operators and owners of underground storage tanks have encased their existing underground tanks (usually steel tanks) with concrete. Others have placed an exterior liner or flexible bag around their underground tanks and backfilled. Both of these techniques require excavation of the tank sites, and replacement or reinstallation of the tanks, along with additional construction. These prior art secondary containment techniques are expensive, time-consuming, cumbersome, and often unreliable.

It is, therefore, desirable to provide an improved underground tank facility which complies with secondary containment regulations and overcomes most, if not all, of the above problems.

SUMMARY OF THE INVENTION

An improved underground tank assembly is provided for storing motor fuels, such as gasoline or diesel fuel, or other liquids. Advantageously, the underground tank assembly complies with significant aspects of secondary containment laws and regulations and is dependable, reliable, safe, and effective. The inventive tank is also relatively inexpensive, easy to install, and readily adaptable for use with existing underground tanks. The underground tank assembly can also be effectively used for storing petrochemicals and other materials.

To this end, the novel underground tank assembly has an internal collapsible primary tank comprising a flexible-expandable bladder located within the interior of a rigid secondary tank or shell. The collapsible primary tank is moveable from a collapsed or contracted, generally empty position to an expanded or inflated, generally full position. The bladder is desirably made of a durable, flexible fluid-impervious material, such as an elastomeric or rubber-like coated material, which is impermeable and chemically inert to motor fuel or other materials which are to be stored in the tank.

The rigid secondary tank is constructed and arranged to surround and enclose the primary tank. The secondary tank is made of a fluid-impervious substantially rigid material, such as metal (e.g. mild carbon steel), or fiberglass. Preferably, metal secondary tanks are also corrosion-resistant, such as by being coated with a rust inhibitor, and/or cathodically protected, to minimize external corrosion.

The underground tank assembly has specially arranged conduits which extend through the top of the exterior secondary tank to a position near or in proximity to the bottom portion of the bladder. The conduits include an inlet conduit to fill the expandable bladder with motor fuel or other material to be stored in the internal primary tank and an outlet conduit to discharge the stored material from the bladder. The outlet conduit can be operatively connected to a pump, such as a submerged pump at its bottom end, and positioned near the floor of the exterior secondary tank adjacent to the bladder. The outlet conduit can also be provided with a suction line or pipe. Numerous alternative or optional conduit arrangements and orientations are also provided for ease and flexibility of assembly, installation, and manufacture.

In the preferred form, the underground tank assembly has at least one intermediate protective barrier wall to protect and isolate the conduits from the expanded bladder. Other safety equipment, features, and controls, such as observation pipes or other leakage detectors can be provided.

A more detailed explanation of the invention is provided in the following description and appended claims take in conjunction with the accompanying drawings.

DETAILED DESCRIPTION OF THE PREFERRED EMBODIMENTS

Figure 1:
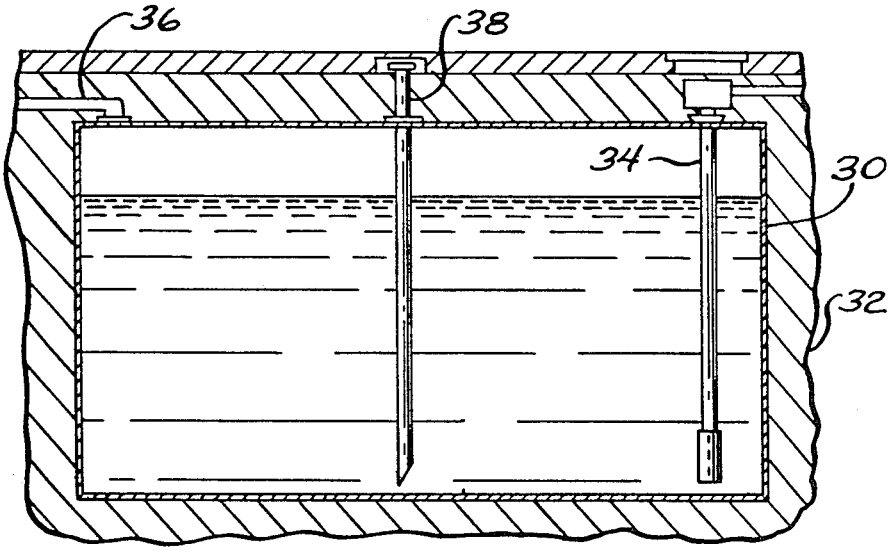
FIG. 1 (PRIOR ART)
FIG. 1 is a cross-sectional view of a prior art underground tank.

A typical prior art, underground storage tank 30 is shown in FIG. 1. The underground tank is a single vessel positioned in the ground 32. The tank has an outlet conduit 34 located at one end and a vent line 36 at its other end, and an inlet conduit extending down from the middle of the tank usually at the tank's vertical center line.

Figure 2:
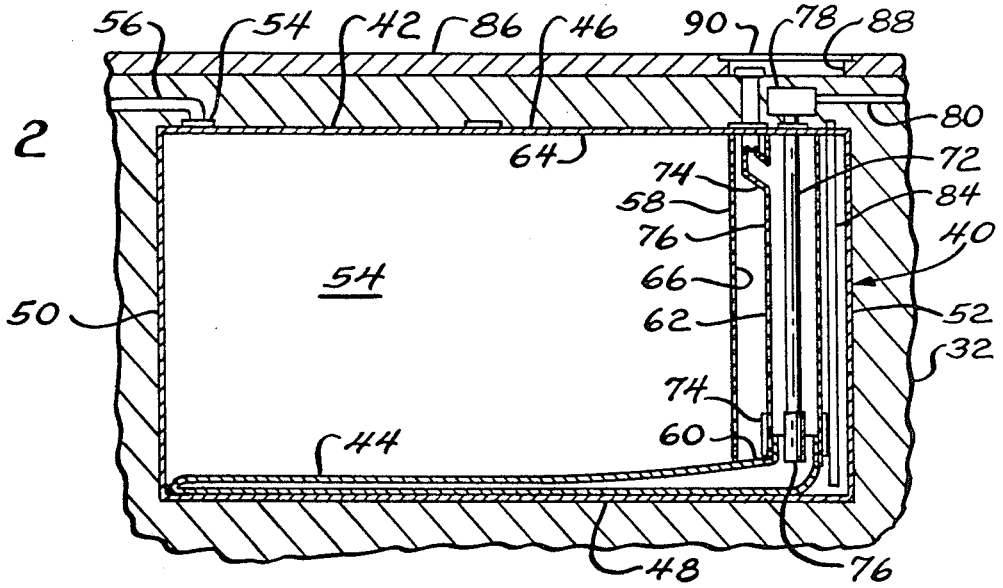
FIG. 2 is a cross-sectional view of an underground tank assembly in a collapsed (contracted) position in accordance with principles of the present invention.
Figure 3:
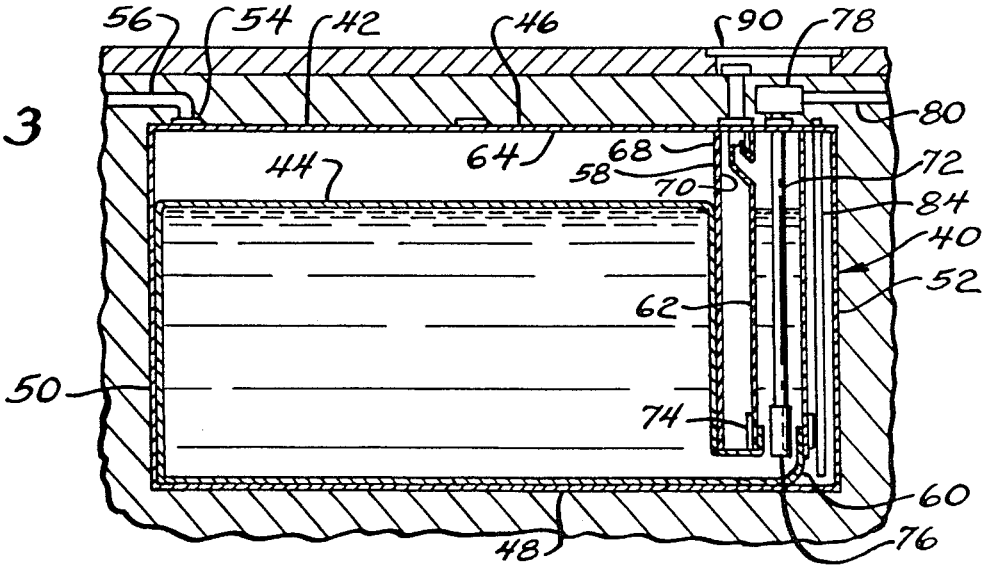
FIG. 3 is a cross-sectional view of the underground tank assembly of FIG. 2 in an expanded (inflated) nearly full position.

Applicant's preferred embodiment of his novel, underground storage tank assembly 40 is shown in FIGS. 2 and 3. The novel underground tank assembly has an underground exterior, substantially rigid, secondary tank 42 which is installed, positioned, and entombed in a subterranean formation or excavation hole in the ground 32 at a desired depth below ground level. The secondary tank is also referred to as an external shell, secondary container or vessel. The external second tank serves as a secondary containment vessel and safety backup for the collection and containment of any leakage of motor fuel, vapors, or other material from the internal flexible primary tank 44. The external secondary tank is made out of a rigid fluid-impervious material, such as mild carbon steel or other metal. Other substantially rigid fluid-impervious materials, such as fiberglass, can also be used. The external metal tank is preferably cathodically protected to minimize external corrosion and/or otherwise incorporates or is coated with a rust inhibitor. The external tank can be cylindrical. Other shapes can also be used.

The external tank 42 has a ceiling which provides a top 46, a floor which provides a bottom 48, lateral end walls 50 and 52, and elongated longitudinal side walls 54 which extend between and connect the top and bottom and end wall of the external tank. A vent 54 and vent conduit 56 are attached to and communicate with the top of the exterior tank for ingress of air when motor fuel or other material is withdrawn from the bladder for pressure balance. The vent conduit 56 preferably extends upwardly above ground.

The exterior secondary tank 40 also has an upright intermediate lateral, protective restraining barrier wall or support 58 located between the end walls. The barrier wall 58 is welded or otherwise fixedly secured and attached to the ceiling and/or side walls of the exterior tank. The barrier wall extends vertically downwardly from the ceiling to a location in proximity to, but spaced above, the floor of the external tank to provide an access opening for a flexible reinforced intermediate conduit or spout 60 which connects the inlet conduit 62 to the internal bladder 44. The upright barrier wall can extend and be secured to the floor of the exterior secondary tank, but desirably has at least one portion spaced slightly above the floor to provide an access opening hole or port to snugly receive the flexible intermediate access conduit. The barrier wall, which is also referred to as a partition, divider, or support, separates, partitions, and divides the interior of the secondary external tank into a bladder-containing compartment, zone or area 64 and conduit-containing compartment, zone or area 66. The barrier wall has a generally planar or flat, bladder-facing side or surface 68 (FIG. 3) which faces the bladder-containing compartment and a generally planar or flat conduit-facing side or surface 70 which faces the conduit-containing compartment. The barrier wall has sufficient structural strength and integrity to resistively contact and support the bladder in its expanded position as shown in FIG. 3 to provide a barrier which protects the inlet conduit as well as the outlet conduit 72, from being compressively engaged by the expanded bladder. In this manner, the barrier wall desirably prevents the inflated bladder from contacting the conduits. The barrier wall is preferably positioned closer to the end wall 52 than to the middle of the exterior tank. In the preferred embodiment, the barrier wall is a perforated foraminous wall, such as netting, to accommodate passage of air from the conduit-containing compartment to the vent of the exterior tank. In some circumstances, it may be desirable to use a fluid-impermeable solid metal wall.

The interior, flexible elastomeric bladder 44 provides an internal underground, expandable and collapsible primary tank which is positioned within the bladder-containing compartment in the interior of the secondary exterior tank. The bladder, which is also sometimes referred to as an inflatable balloon-like fuel cell, diaphragm, or liner, serves as the primary containment vessel for storing and containing a motor (engine) fuel, such as gasoline or diesel fuel, or some other material. The internal bladder is made of a fluid-impervious elastomeric or rubber-like coated fabric or material, such as a nitrile rubberized nylon fabric which is substantially impermeable and chemically inert to the motor fuel or other material to be stored in the internal tank. The bottom portion of the bladder is positioned adjacent to the bottom of the exterior secondary tank. The internal bladder is moveable, expandable, and inflatable from a contracted, collapsed, and deflated, generally empty position upon the floor of the exterior secondary tank as shown in FIG. 2, to an expanded and inflated, full (filled) position expansively contacting and engaging the bladder-facing side 68 of the barrier wall 58 as shown in FIG. 3. The flexible internal bladder, when expanded and filled, substantially conforms to the shape of the interior of the bladder-containing compartment of the exterior secondary tank. The bladder preferably has sufficient capacity to be expanded from the floor to the ceiling of the secondary tank. In some circumstances, it may be desirable not to expand and fill the bladder to such an extent that it contacts and presses against the ceiling of the secondary tank, so as to provide a vapor-collection space between the top of the bladder and the secondary tank's ceiling for passage and collection of vapors and gaseous pressure from the bladder.

The inlet conduit 62 has a bifurcated Y-shaped inlet portion 74 which extends through the top of the secondary tank to provide a passageway for filling the bladder with motor fuel or other material. The inlet conduit has an elongated upright or vertical portion 76 which is sealably attached to and extends from the top of the secondary tank to a position in proximity to the bottom portion of the bladder and the floor of the secondary tank. In the preferred embodiment, the upright portion of the inlet conduit has about the same height as the barrier wall 58 and telescopically receives and is fixedly and sealingly attached to the mouth of the intermediate flexible access conduit 60 by fastening means such as a hose clamp 74. The hooked arcuate finger-like inwardly facing arm of the bifurcated Y-shaped inlet portion can have a smaller diameter than the upright portion of the inlet conduit.

The outlet conduit 72 extends through the top of the exterior secondary tank to discharge and withdraw motor fuel or other stored material from the interior of the bladder. The outlet conduit has an elongated vertical or upright portion which extends vertically from the top of the exterior secondary tank to a position in proximity to the bottom portion of the bladder and the floor of the secondary tank. The upright and vertical portions of the inlet and outlet conduits are preferably made of metal pipe or other rigid material which is impervious and chemically inert to motor fuel or other material to be stored in the bladder. The vertical portion of the outlet conduit has a substantially smaller diameter than the upright portion of the inlet conduit and is positioned within the interior of the inlet conduit, preferably along the vertical axis of the upright portion of the inlet conduit, so that the upright portion of the inlet conduit concentrically and coaxially surrounds the vertical portion of the outlet conduit.

A submerged pump 76 is securely connected to and positioned at the bottom end of the outlet conduit near the bottom portion of the bladder to enhance removal of the motor fuel or other material stored in the bladder. The submerged pump is vertically positioned within the mouth of the intermediate flexible access conduit.

The upper end of the outlet conduit is connected to a manifold 78 and to a transverse or a horizontal outlet pipe 80 which can extend to an aboveground outlet nozzle, spout, or dispenser. The vertical portion of the outlet conduit, as well as the upright portion of the inlet conduit, is positioned within the interior of the conduit-containing compartment of the exterior secondary tank.

An elongated rigid, upright observation or sampling conduit, pipe, or sight tube 84 extends vertically upwardly from a position near the floor of the exterior secondary tank through the top of the secondary tank at a location spaced outwardly of the bladder as well as outwardly of the upright vertical portions of the inlet and outlet conduits. The observation pipe has an accessible top portion which extends upwardly from the ceiling of the secondary tank for a sufficient distance to be readily and easily accessible from ground level to enable an aboveground operator to look and peek into the top of the observation pipe or to gather a sample from the bottom of the tank with a suitable sampling device. The observation pipe serves as a leakage detector and has a bottom portion spaced slightly above the floor of the exerior secondary tank to permit the aboveground operator to readily observe and detect the presence of water or motor fuel in the bottom of the secondary containment tank. The presence of motor fuel on the floor of the exterior secondary tank will usually indicate a leak in the internal bladder. The presence of water on the floor of the exterior secondary tank will usually indicate a leak or fault in the exterior secondary tank which permits inward seepage of groundwater or water from an underground aquifer.

In the preferred embodiment, the top of the ground is covered with access road, top soil, or a cover 86 and has an access opening 88 and a removable lid or cover 90 which permits access to the inlet conduit, manifold and observation pipe. The observation pipe can extend upwardly into the access opening 88 at a location spaced laterally away from the horizontal outlet pipe 80.

Figure 4:
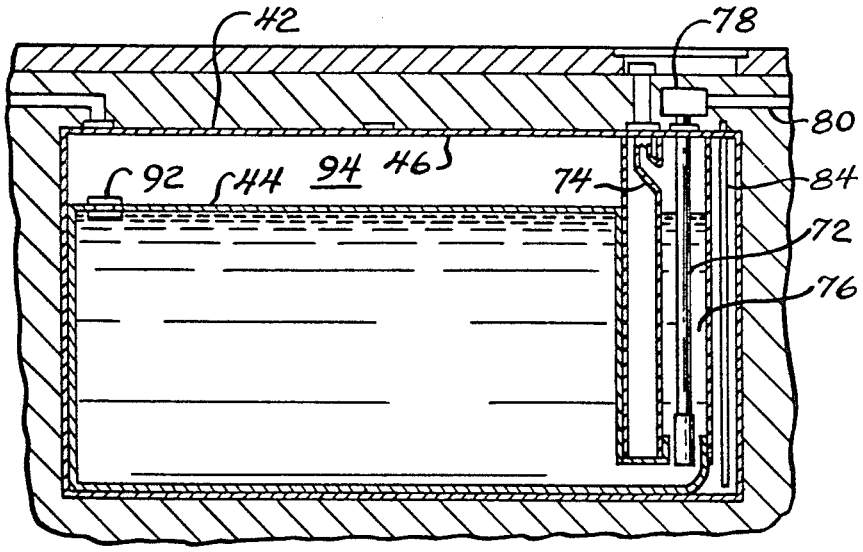
FIG. 4 is a cross-sectional view similar to FIG. 3, but with the internal bladder equipped with a vent.

The underground storage tank assembly of FIG. 4 is substantially identical to the underground storage tank assembly of FIGS. 2 and 3, except that the top of the internal bladder 44 has a gas vent, vapor outlet, or one-way pressure-relief valve 92 for passage of vapors, but not liquids, and relief of excess internal gas pressure from the interior of the bladder into the vapor-collection space 94 between the top of the bladder and the ceiling of the exterior secondary tank.

Figure 5:
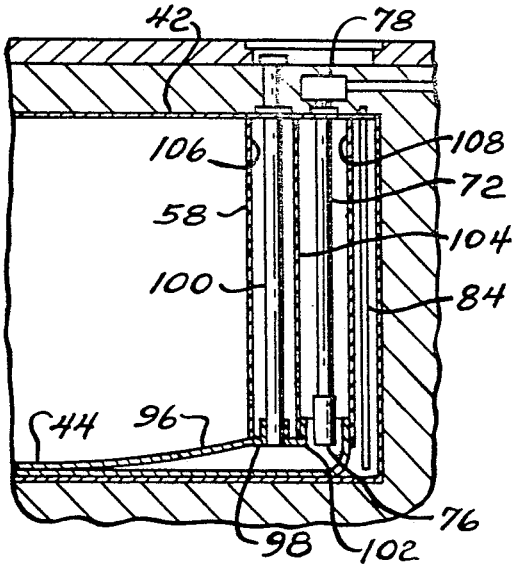
FIG. 5 is a fragmentary cross-sectional view of another underground tank assembly in a collapsed position in accordance with principles of the present invention.
Figure 6:
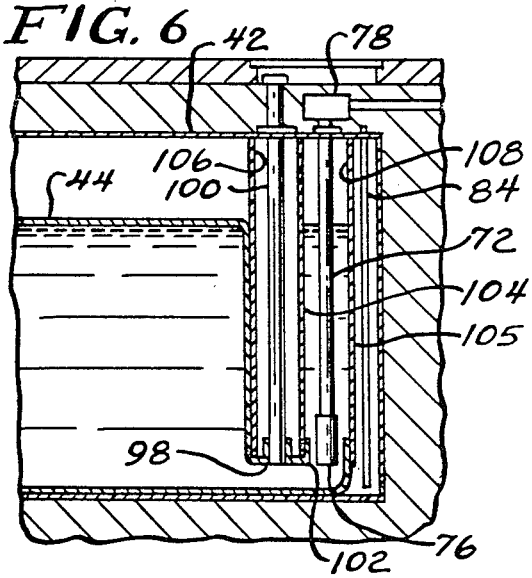
FIG. 6 is a fragmentary cross-sectional view of the underground tank assembly of FIG. 5 in an expanded position.

The underground storage tank assembly of FIGS. 5 and 6 is structurally and functionally similar to the underground storage tank assembly of FIGS. 2 and 3, except that the flexible intermediate conduit or spout 96 which connects the internal bladder 44 to the inlet and outlet conduits has an inlet port and collar 98 to snugly receive and sealingly engage the bottom end of the inlet conduit 100 and has an outlet port 102 to receive the submerged pump 76 at the bottom end of the outlet conduit 72. The inlet conduit can be spaced inwardly, away from, and parallel to the outlet conduit. The vertical inlet conduit of FIGS. 5 and 6 does not have a bifurcated generally Y-shaped inlet portion as in the underground storage tank assembly of FIGS. 2 and 3.

In the underground tank assembly of FIGS. 5 and 6, second and third upright intermediate restraining protective barrier walls 104 and 105 are positioned longitudinally outwardly of and parallel to the first upright intermediate protective barrier wall 58 at a location between and separating the inlet and outlet conduits 100 and 72. The barrier walls are structurally similar to the barrier walls of FIGS. 2 and 3. The second and third barrier walls are also referred to as partitions or dividers, and separate, partition and divide the conduit-containing compartment into an inlet conduit-containing compartment 106 which contains substantial portions of the inlet conduit and an outlet conduit-containing compartment 108 which contains substantial portions of the outlet conduit. The second and third barrier walls are positioned parallel to the first barrier wall and extend to about the same depth from the ceiling as the first barrier wall. The second and third barrier walls are fixedly secured to the ceiling and/or sidewalls of the external secondary tank 42 in the same manner as the first barrier wall.

Figure 7:
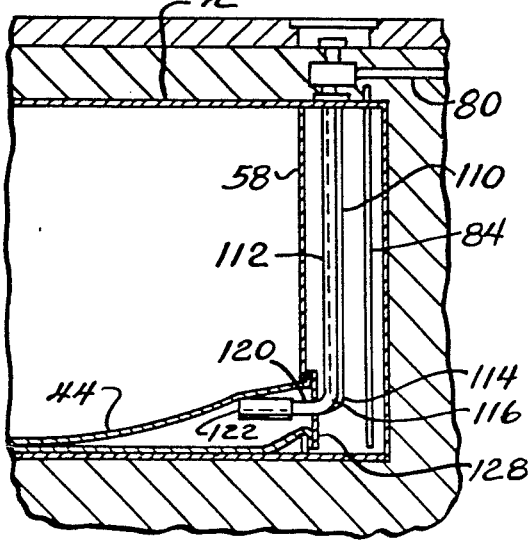
FIG. 7 is a fragmentary cross-sectional view of still another underground tank assembly in a collapsed position in accordance with principles of the present invention.
Figure 8:
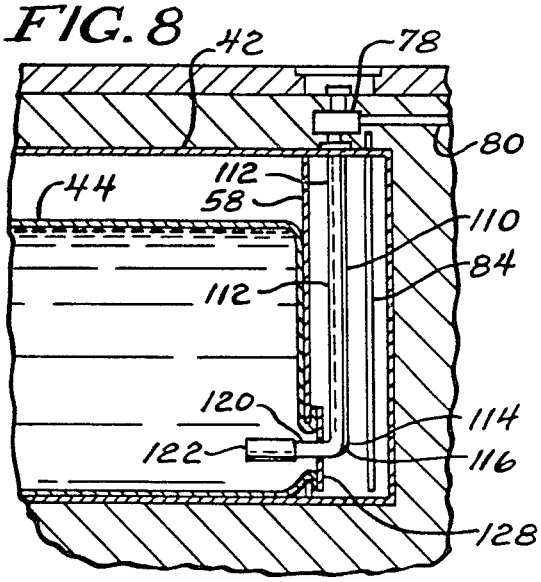
FIG. 8 is a fragmentary cross-sectional view of the underground tank assembly of FIG. 7 in an expanded position.
Figure 9:
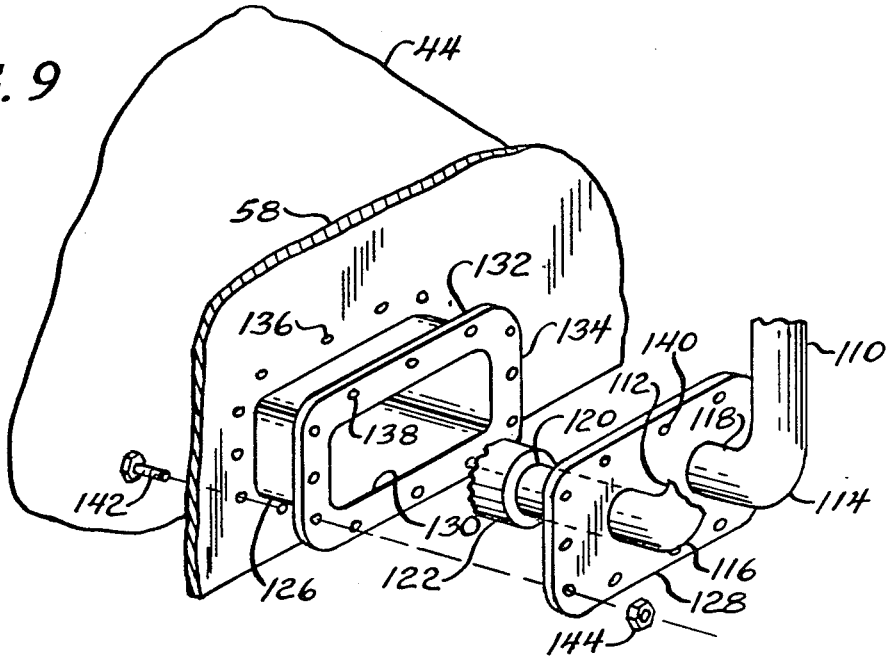
FIG. 9 is an assembly drawing of portions of the conduits and bladder ports of the embodiments of FIGS. 7 and 8.

The underground storage tank assembly of FIGS. 7–9 is structurally and functionally similar to the underground storage tank assembly of FIGS. 2 and 3, except that the inlet and outlet conduits 110 and 112 have lower, bent perpendicular arm sections 114 and 116 with horizontal end portions 118 and 120, respectively, which extend horizontally into the interior of the internal bladder 44. The submerged pump 122 is connected to and extends horizontally and laterally inwardly from the bottom end of the horizontal portion of the outlet conduit within the interior of the bladder. Instead of a flexible intermediate conduit, a rigid, formed, or molded flange plate, collar, or spout 126 (FIG. 9) and a face plate or cover plate 128 are provided to connect the bladder to the inlet and outlet conduits. Collar 126 has a rectangular or oval access opening and port 130 for receiving the submerged pump as well as the horizontal portions of the inlet and outlet conduits. The collar is sealed, clamped, or an integral part of the bladder. The collar has a peripheral flange 132 with a generally planar and flat outer surface 134 to sealingly abut against and receive the generally planar and flat inwardly-facing surface of the face plate. The bottom portion of the upright protective barrier wall 58 has bolt holes 136 which are aligned with bolt holes 138 and 140 in the flange and cover plate to receive bolts 142 and nuts 144 or other fasteners which securely fasten and connect the flange and cover plate to the barrier wall. The collar, flange plate, bolts and nuts are made up of a rigid fluid-impervious material, such as metal, which is chemically inert to motor fuel or other material to be stored in the internal bladder. The submerged pump and conduits preferably have a cooling flow bypass circuit to return the fuel or other material to the inlet conduit when the outlet/exit of the outlet pipe has not been opened.

Figure 10:
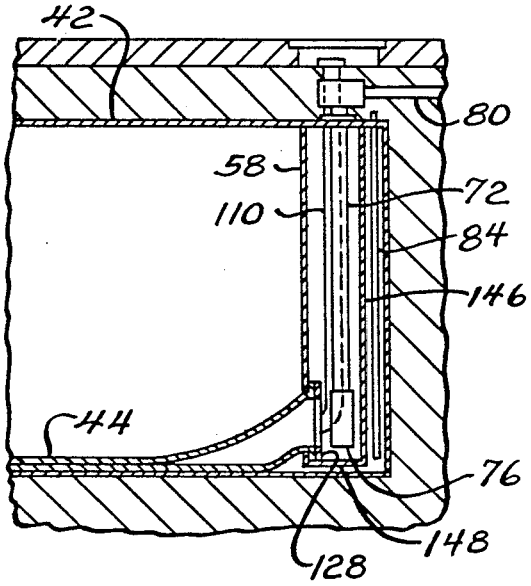
FIG. 10 is a fragmentary cross-sectional view of another underground tank assembly in a collapsed position in accordance with principles of the present invention.
Figure 11:
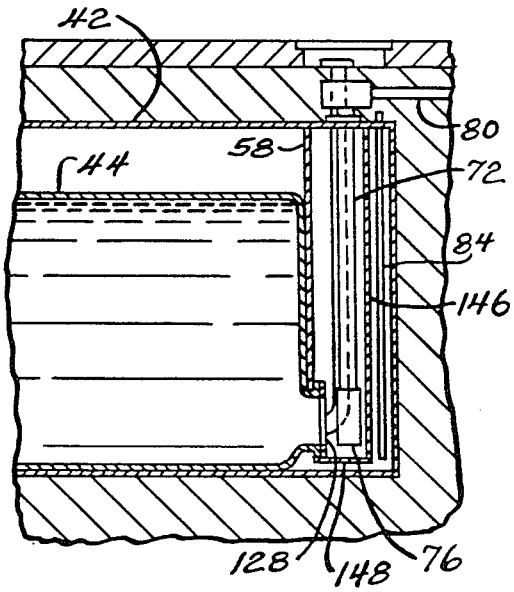
FIG. 11 is a fragmentary cross-sectional view of the underground tank assembly of FIG. 10 in an expanded position.

The underground storage tank assembly of FIGS. 10 and 1 is structurally and functionally similar to the underground storage tank of FIGS. 7–9, except that the outlet conduit 72 and the submerged pump 76 are positioned vertically at a location outward of the bladder 44. Also, a second intermediate fluid-impervious restraining barrier wall 146 which is structurally similar to the first intermediate fluid-impervious restraining barrier wall 58, is positioned between and separates the conduits from the sight tube 84. The barrier walls are parallel and extend from the ceiling and are connected to a bottom portion 148 which is spaced slightly above the bottom of the exterior secondary tank to provide communication between the sight tube and the interior of the bladder-containing compartment.

Figure 12:
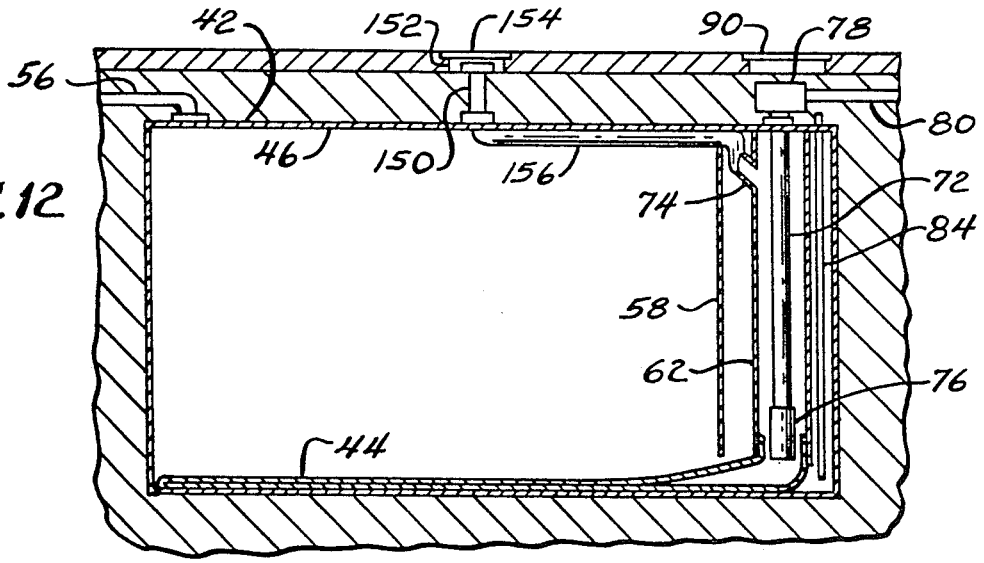
FIG. 12 is a cross-sectional view of a different underground tank assembly in a collapsed position in accordance with principles of the present invention.
Figure 13:
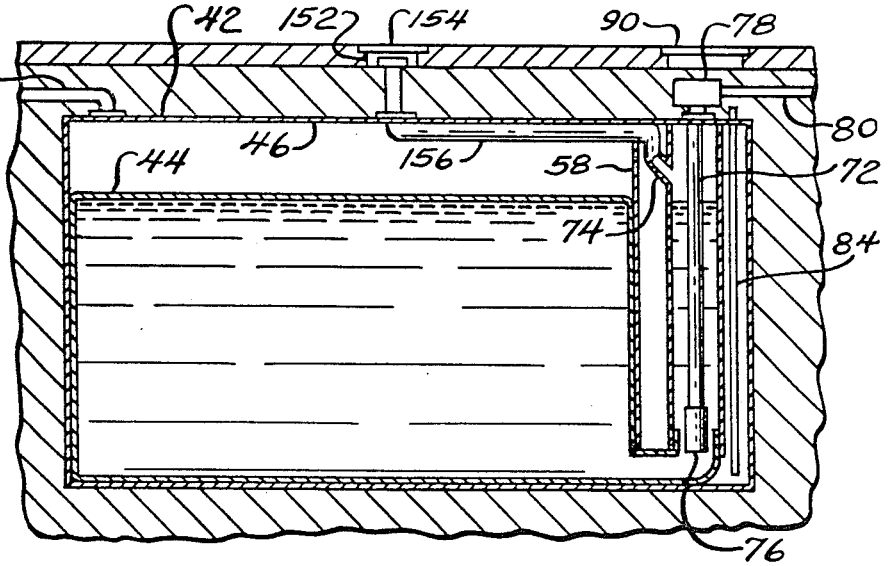
FIG. 13 is a cross-sectional view of the underground tank assembly of FIG. 12 in an expanded position.

The underground storage tank assembly of FIGS. 12 and 13 is structurally and functionally similar to the underground storage tank assembly of FIGS. 2 and 3, except that the inlet conduit 62 has an upper upright inlet feed portion and mouth 150 which extends vertically upwardly from the middle of the secondary tank's ceiling 46 along the vertical axis of the exterior secondary tank 42 into an access opening or manhole 152 which is covered by a removable lid or cover 154, so that the inlet feed portion of the inlet conduit is generally accessible from ground level at about the middle of the exterior secondary tank. A horizontal, rigid pipe or conduit 156, sometimes referred to as the horizontal pipe portion of the inlet conduit, connects the bottom of the upper inlet portion of the inlet conduit to the inwardly extending arm of the bifurcated generally Y-shaped inlet portion 74 of the inlet conduit. The horizontal pipe is secured against the underside of the ceiling of the exterior secondary tank. The upper end of the intermediate protective barrier wall 58 has an opening or hole adjacent to the ceiling 46 of the exterior secondary tank to accommodate the horizontal pipe. In some circumstances it may be desirable that the horizontal pipe 156 comprise a flexible conduit.

The internal bladders 44 of FIGS. 5–13 can be provided with a gas vent, vapor outlet, or pressure-relief one-way valve similar to that shown in FIG. 4.

Figure 14:
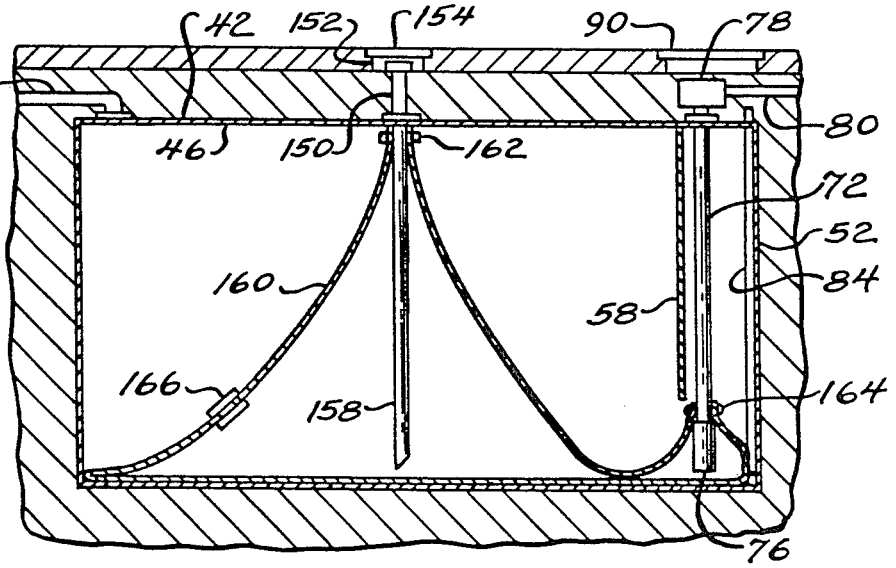
FIG. 14 is a cross-sectional view of a modified underground tank assembly in a collapsed position in accordance with principles of the present invention.
Figure 15:
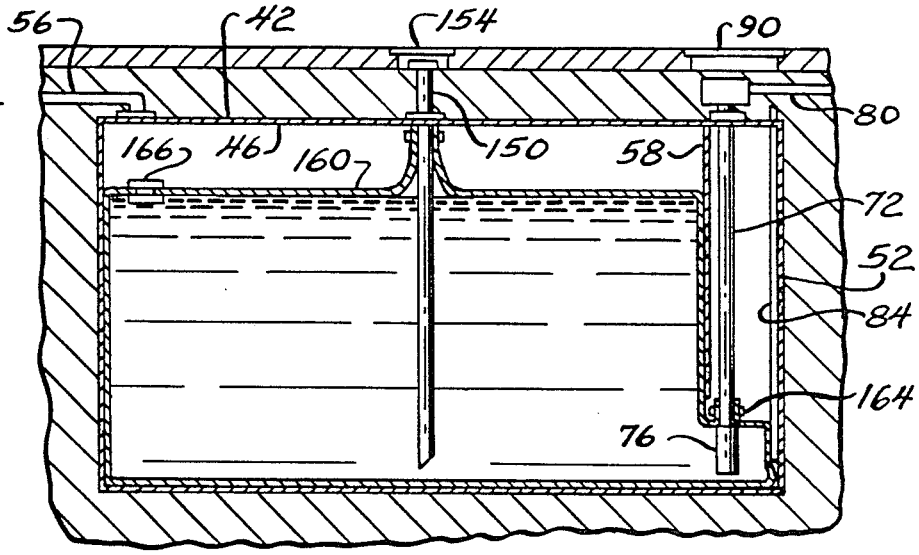
FIG. 15 is a cross-sectional view of the underground tank assembly of FIG. 14 in an expanded position.

The underground storage tank assembly of FIGS. 14 and 15 is structurally and functionally similar to the underground storage tank assembly of FIGS. 12 and 13, except that the elongated upright portion 158 of the inlet conduit extends vertically downwardly from the vertical upper inlet feed portion 150 of the inlet conduit along the middle and vertical axis of the secondary exterior tank 42. The upright portion of the inlet conduit extends downwardly to a position in proximity to the bottom portion of the internal bladder 160 and the floor of the external secondary tank 42. The top center portion of the internal bladder is securely connected to the upper section of the upright portion of the inlet conduit with a hose clamp 162 or other fastening means at a position generally adjacent to the ceiling 46 of the exterior secondary tank. The lower outlet end of the bladder is securely connected to the lower end of the outlet conduit 72 by a hose clamp 164 or by other suitable fastening means at a location just above the submerged pump 76, so that the submerged pump is positioned within the interior of the bladder. The bladder is equipped with a gas vent, vapor outlet, or pressure-relief one-way valve 166 in a manner similar to that shown in FIG. 4. The submerged pump and outlet can also have a cooling flow bypass circuit similar to that described with respect to FIGS. 7–9.

Figure 16:
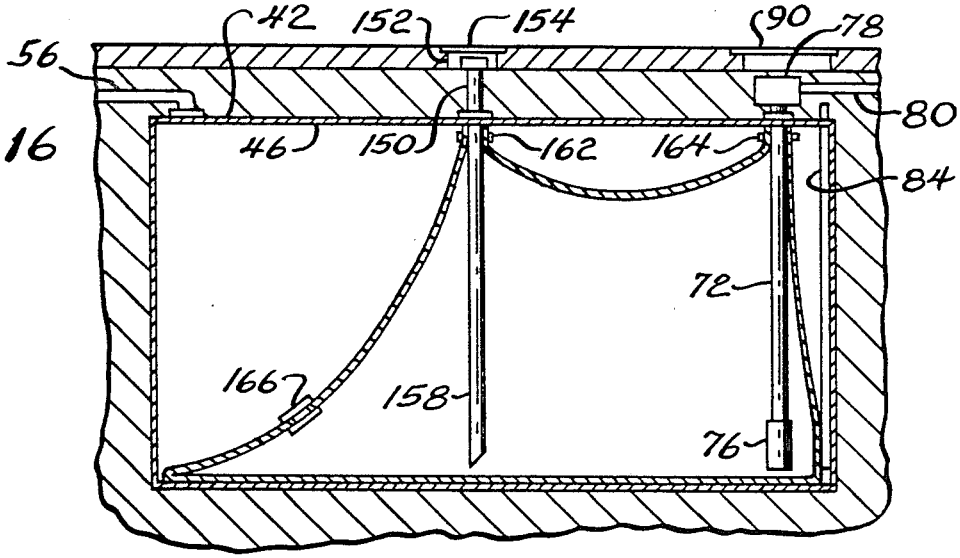
FIG. 16 is a cross-sectional view of another embodiment of an underground tank assembly in a generally collapsed position in accordance with principles of the present invention.
Figure 17:
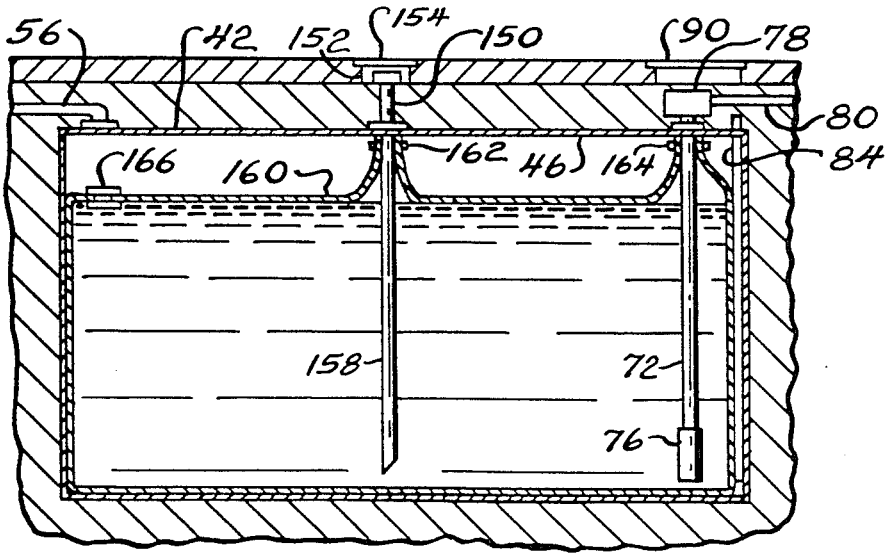
FIG. 17 is a cross-sectional view of the underground tank assembly of FIG. 16 in an expanded position.
Figure 18:
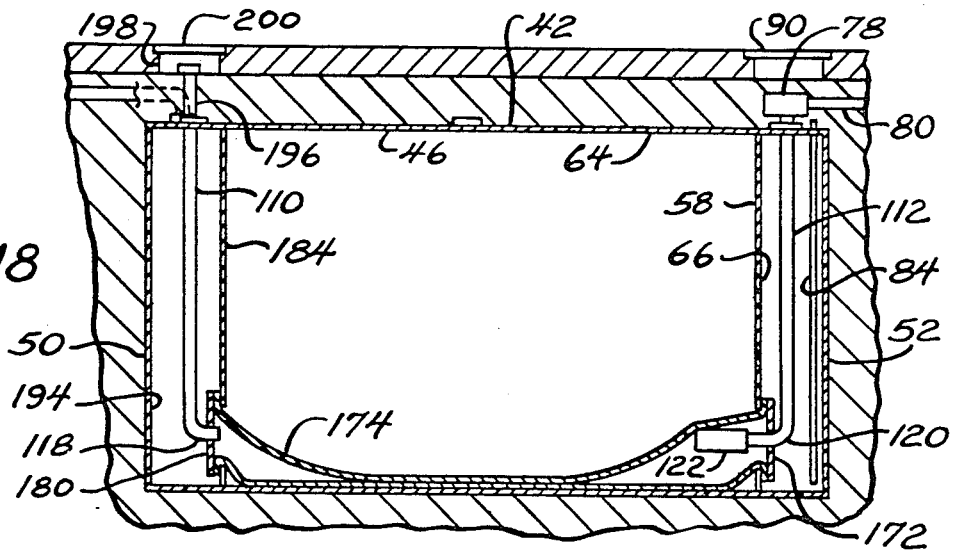
FIG. 18 is a cross-sectional view of another underground tank assembly in a collapsed position in accordance with principles of the present invention.
Figure 19:
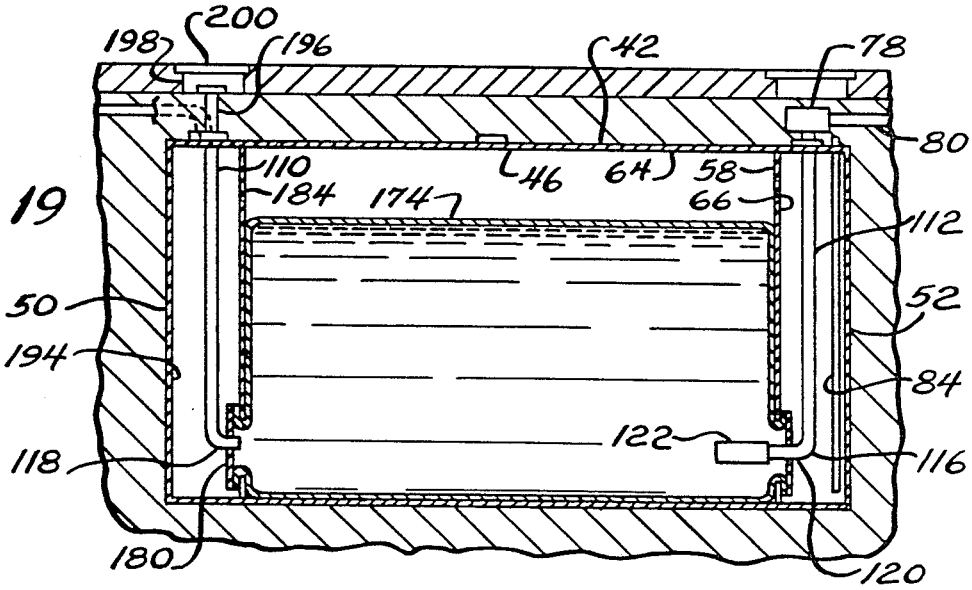
FIG. 19 is a cross-sectional view of the underground tank assembly of FIG. 18 in an expanded position.
Figure 20:
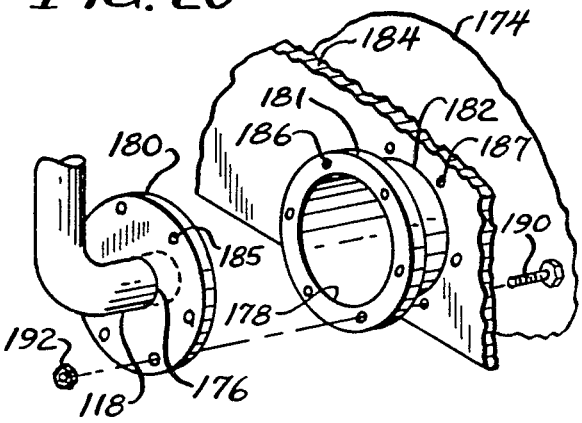
FIG. 20 is a perspective assembly drawing of the inlet conduit and inlet bladder port of the underground tank assembly of FIGS. 18 and 19.
Figure 21:
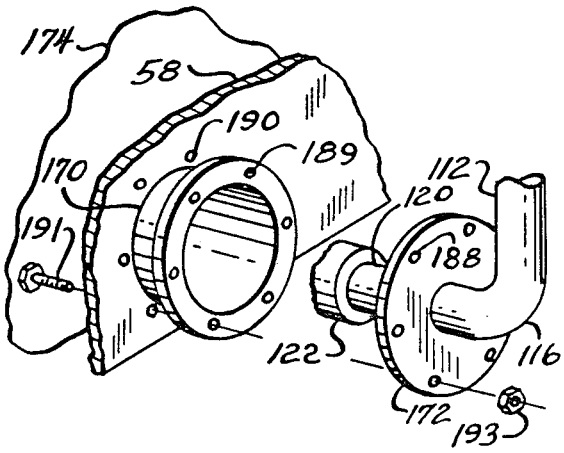
FIG. 21 is a perspective assembly drawing of portions of the outlet conduit and outlet bladder port of the underground tank assembly of FIGS. 18 and 19.

The underground storage tank assembly of FIGS. 16 and 17 is structurally and functionally similar to the underground storage tank assembly of FIGS. 14 and 15, except that the outlet portion of the bladder is securely connected at its upper end to the upper section of the vertical portion of the outlet conduit 72 by a hose clamp 166 or other suitable fastening means at a location just below the ceiling 46 of the exterior secondary tank 42.

The underground storage tank assembly of FIGS. 18–21 is structurally and functionally similar to the underground storage tank assembly of FIGS. 7–9, except that a formed, flexible, circular flanged outlet, plate, or collar 170 (FIG. 21) and an outlet circular face plate (cover plate) 172 receive only the submerged pump 122 and horizontal portion 120 of the outlet conduit 112 at a location in general proximity to the right end wall 52 of the exterior secondary tank 42 and the inlet conduit 110 is positioned in general proximity to the left end wall 50 of the exterior secondary tank with its horizontal outlet portion 118 extending inwardly into the interior of the expandable bladder 174 through the circular openings, holes, or ports 176 (FIG. 20), 178, and 182 of an inlet circular face plate 180, a molded resilient inlet circular flange or plate (collar) 182, and a second intermediate, upright protective barrier support wall 184, respectively. The inlet and outlet cover plates and flanges are structurally similar. The inlet and outlet cover plates and flanges, as well as the restraining walls 58 and 184, have aligned bolt holes 185–190 to receive bolts 190 or 191 and nuts 192 or 193 which securely connect the cover plates and flanges to the bottom portion of the barrier walls.

The inlet (second) intermediate barrier restraining wall 184 (FIGS. 18 and 19) is structurally similar and positioned parallel to the outlet (first) intermediate barrier restraining wall 58. The inlet barrier wall is fixedly secured to the ceiling 46 and/or longitudinal side walls of the exterior secondary tank 42 in a manner similar to the outlet barrier wall. The inlet barrier wall is also referred to as a partition or divider, and separates, partitions, and divides the interior of the secondary tank into an inlet (second) conduit-containing compartment 194 which contains substantial portions of the inlet conduit 110. The outlet (first) conduit-containing compartment 66 is positioned between the outlet barrier wall 58 and the right end wall 52, and contains substantial portions of the outlet conduit 112.

The internal bladder 174 (FIGS. 18 and 19) is positioned, constrained, and contained between the inlet and outlet barrier walls 184 and 58. The bladder-containing compartment 64 is positioned between the inlet and outlet conduit-containing compartments.

The inlet and outlet barrier walls 184 and 58 contact, support, engage and restrain the internal bladder when the bladder is expanded and filled with motor fuel or other material. The inlet and outlet barrier walls provide a barrier which protects the vertical portions of the inlet and outlet conduits, respectively, from being compressively engaged by the expanded bladder.

The upper inlet portion 196 (FIGS. 18 and 19) of the inlet conduit 110 extends vertically above the ceiling 46 of the external secondary tank into an access opening or manhole 198, near ground level, which is covered by a removable lid or cover plate 200, for easy access, filing, and inventory checking. Both the top of the internal bladder and the ceiling of the exterior secondary tank can have a vent for relief of excess internal gas pressure.

In some circumstances, it may be desirable that the intermediate restraining barrier wall(s) be tubular and concentrically or eccentrically surround one or more of the conduits.

Although embodiments of this invention have been shown and described, it is to be understood that various modifications and substitutions, as well as rearrangements and combinations of parts, equipment, and/or components, can be made by those skilled in the art without departing from the novel spirit and scope of this invention.

What is claimed is:

1. An underground tank assembly for storing motor fuels, chemicals, or other materials, comprising:

an underground secondary containment vessel for secondary containment of any leakage of motor fuels, chemicals, or other materials from a primary containment vessel, said underground secondary containment vessel comprising an external substantially rigid secondary tank having a ceiling, a floor, upright wall means extending between and connecting said ceiling and said floor, said upright wall means including end portions and a first intermediate upright protective barrier wall conected to said ceiling or said wall means between said end portions, said first intermediate upright protective barrier wall separating and partitioning said secondary tank into a bladder-containing compartment and at least one conduit-containing compartment, and said first intermediate upright protective barrier wall having a bladder-facing said bladder-containing compartment and a conduit-facing side facing said conduit-containing compartment;

an underground primary containment vessel comprising an internal expandable primary tank positioned within the bladder-containment compartment in the interior of said secondary containment tank for containing said motor fuels, chemicals, or other materials, said primary containment vessel being expandable from a substantially empty collapsed position in proximity to said floor to a substantially full expanded position expansively contacting and engaging said bladder-facing side of said first intermediate upright protective barrier wall;

an inlet conduit positioned in said conduit-containing compartment and connected to and communicating with said primary containment vessel for filling said primary tank with said motor fuels, chemicals, or other materials, said outlet conduit having an elongated upright portion facing said conduit-facing side of said first intermediate upright protective barrier; and an outlet conduit connected to and communicating with said underground primary containment vessel for removing said motor fuels, chemicals or other materials from said primary tank, said outlet conduit being positioned in said conduit-containing compartment and having a generally upright portion; and said first intermediate upright protective barrier wall having sufficient strength and integrity for resistively contacting and supporting said expandable primary tank in said expanded position and providing a barrier for protecting said inlet conduit from being compressively engaged by said expanded primary tank.

2. An underground tank assembly in accordance with claim 1 including a second intermediate upright protective barrier wall positioned in said conduit-containing compartment between said outlet conduit and said inlet conduit, and said second intermediate upright protective barrier wall being spaced from and cooperating with said first intermediate upright protective barrier wall to define an inlet conduit-containing compartment about said inlet conduit.

3. An underground tank assembly in accordance with claim 2 including:

an elongated upright sight tube having a bottom portion spaced slightly above said floor;

a third intermediate upright protective barrier wall positioned between said outlet conduit and said upright sight tube; and said third intermediate upright protective barrier wall being spaced from and cooperating with said second intermediate upright protective barrier wall to define an outlet conduit-containing compartment about said outlet conduit.

4. An underground tank assembly for storing motor fuels, comprising:

an underground substantially rigid secondary tank for secondary containment of any leakage of motor fuel from a primary tank, said secondary tank comprising a substantially rigid fluid-impermeable material selected from the group consisting of metal and fiberglass, said secondary tank having a top, a floor, end walls extending between and connecting said top and floor, at least one intermediate protective barrier wall located between said end walls, and a vent attached to and communicating with said top, said intermediate protective barrier wall separating, partitioning, and dividing said secondary tank into a bladder-containing compartment and at least one conduit-containing compartment, and said intermediate protective barrier wall having a bladder-facing side facing said bladder-containing compartment and a conduit-facing side facing said conduit-containing compartment;

an underground expandable primary tank positioned substantially within the bladder-containing compartment in the interior of said secondary tank for containing a motor fuel selected from the group consisting of gasoline and diesel fuel, said expandable primary tank comprising a generally flexible bladder having a bottom portion lying upon and positioned against the floor of said secondary tank, said bladder being substantially impermeable to and chemically inert to said motor fuel and being moveable from a contracted generally empty position upon said floor of said secondary tank to an expanded substantially full position expansively contacting and engaging said bladder-facing side of said intermediate protective barrrer wall;

an inlet conduit extending through the top of said secondary tank for filling said bladder with motor fuel, said inlet conduit has an elongated upright portion extending substantially vertically from a position in proximity to the top of said secondary tank to a position in proximity to the bottom portion of said bladder;

an outlet conduit extending through the top of said secondary tank for discharging and withdrawing motor fuel from said bladder, said outlet conduit having an elongated vertical portion extending substantially vertically from the top of said secondary tank to a position in proximity to the bottom portion of said bladder, said elongated vertical portion of said outlet conduit being positioned in said conduit-containing compartment of said secondary tank; and said intermediate protective barrier wall having sufficient structural strength and integrity for resistively contacting and supporting said bladder in said expanded position and providing a barrier for protecting said inlet conduit from being compressively engaged by said expanded bladder.

5. An underground tank assembly in accordance with claim 4 wherein said upright portion of said inlet conduit and said vertical portion of said outlet conduit are both positioned in the conduit-containing compartment of said secondary tank.

6. An underground tank assembly in accordance with claim 4 including a submerged pump secured to and positioned at the bottom end of said outlet conduit near the bottom portion of said bladder.

7. An underground tank assembly in accordance with claim 6 wherein said outlet conduit has a lower bent section with a generally horizontal portion and said submerged pump extends from said horizontal portion and is laterally positioned within the interior of said bladder.

8. An underground tank assembly in accordance with claim 4 wherein said upright portion of said inlet conduit and said vertical portion of said outlet conduit comprise substantially rigid pipes and said inlet portion includes a flexible conduit connecting said bladder to said pipe of said inlet conduit.

9. An underground tank assembly in accordance with claim 4 wherein said intermediate protective barrier wall comprises an imperforate solid wall.

10. An underground tank assembly in accordance with claim 4 wherein said intermediate protective barrier wall comprises a perforated foraminous wall.

11. An underground tank assembly in accordance with claim 10 wherein said foraminous wall includes netting.

12. An underground tank assembly in accordance with claim 4 wherein said bladder has an upper portion with a vent.

13. An underground tank assembly in accordance with claim 4 including a leakage detector comprising an elongated substantially rigid, upright conduit extending generally upwardly from a position near the floor of said secondary tank through the top of said secondary tank at a location spaced outwardly of said bladder for detecting the presence of water or motor fuel on the floor of said secondary tank.

* * * * *

UNITED STATES PATENT OFFICE
CERTIFICATE OF CORRECTION

Patent No. 4,763,805 Dated August 16, 1988

Inventor(s) Dennis J. Strock

It is certified that error appears in the above-identified patent and that said Letters Patent is hereby corrected as shown below:

| Column | Line | |
|---|---|---|
| 2 | 42 | "take" should read --taken-- |
| 7 | 43 | "1" should read --11-- |
| 9 | 64 | "conected" should read --connected-- |
| 10 | 3 | "said" should read --side facing said-- |
| 11 | 26 | "barrrer" should read --barrier-- |

Signed and Sealed this

Twelfth Day of June, 1990

*Attest:*

HARRY F. MANBECK, JR.

*Attesting Officer*

*Commissioner of Patents and Trademarks*